United States Patent [19]

Otani

[11] 3,995,351

[45] Dec. 7, 1976

[54] FLAT SECTION IN CARDING MACHINE

[75] Inventor: Susumu Otani, Ohbu, Japan

[73] Assignee: Kabushiki Kaisha Toyoda Jidoshokki Seisakusho, Kariya, Japan

[22] Filed: July 16, 1975

[21] Appl. No.: 596,242

[30] Foreign Application Priority Data

July 23, 1974 Japan ..... 49-86879

[52] U.S. Cl. ..... 19/102

[51] Int. Cl.[2] ..... D01G 15/82

[58] Field of Search ..... 19/113, 102, 111

[56] References Cited

OTHER PUBLICATIONS

Rieter, German Published Application No. 2,313,720 printed Sept. 27, 1973.

*Primary Examiner*—Dorsey Newton

*Attorney, Agent, or Firm*—Wenderoth, Lind & Ponack

[57] ABSTRACT

A flat section is positioned above a cylinder of a flat carding machine to accomplish a carding action therebetween. The flat section comprises a pair of endless chains supported for rotation in spaced relationship with each other, and a number of flat bars bridged between the paired chains so that they are arranged parallel to each other with clearances therebetween. One end of each flat bar is connected to a connected portion of one chain at which adjacent chain links are connected together and the other end of each flat bar is similarly connected to a corresponding connected portion of the other chain. Between each adjacent pair of flat bars is positioned a closing member, the opposite ends thereof being connected between the adjacent connected portions of the paired chains so that a longitudinal center axis of each closing member coincides with that of the associated clearance in all positions thereof with respect to the direction of rotation of the chains.

4 Claims, 5 Drawing Figures

FLAT SECTION IN CARDING MACHINE

BACKGROUND OF THE INVENTION

This invention relates to a rotary flat section having flat clothings opposed to a cylinder in a carding machine to accomplish a carding action, and more particularly to means for preventing air as well as undesirable material, such as, short fiber, dirt and the like from blowing-off out of the flat section through clearances present between adjacent flat bars composing the flat section.

Heretofore, for this purpose of preventing the air blowing-off, various arrangements have been proposed. For example, Japanese Patent Publication No. 40-26214 discloses a method of cleaning a flat in a carding machine, wherein the rotary flat is contained in a chamber provided with various air blast and suction nozzles to provide a stream of air in the chamber, causing the undesirable material blown off in the chamber to be discharged through the suction nozzles together with the air stream. As will be understood, however, an apparatus for bringing this method into operation necessarily requires a large-sized cover to form the chamber, the various nozzles to circulate air through the chamber, a blower to supply air through the blast nozzles, a filter means to filter air, which includes the undesirable material, passed through the suction nozzles, etc. This results in the disadvantage that the apparatus becomes of great size and is costly to manufacture.

Another known device is shown in Japanese laid-open Utility Model Specification No. 48-38117, which discloses an air blow-off preventing device of a relatively simple construction comprising a closing plate connected to each flat bar to extend over a clearance between the adjacent flat bars. The closing plate is provided with an elastic plate on its one side which is opposed to the cylinder of the carding machine. With this prior art arrangement, the construction thereof is relatively simple. However, since the longitudinal center axis of the flat bar does not coincide with that of the associated clearance, a considerable width of a closing plate is required to fully cover the clearance. Such a widened closing plate and accordingly an elastic plate has to be subject to deformation whenever one flat bar makes an angle relative to other flat bars, resulting in a short life of the closing and elastic plates. It is very difficult or troublesome to fixedly secure the closing plate to the flat bar. This is because the closing plate usually has to be secured to a back portion of the cast iron flat bar. In addition, depending on the configuration of the flat bar, there the disadvantageous situation that the closing plate can not be positioned to close the overall longitudinal length of the clearance between the adjacent flat bars. When grinding flat needles or replacing a flat clothing, the closing plate has to be removed from the associated flat bar, since it is fixed to the flat bar.

It is accordingly an object of this invention to eliminate the above disadvantages of the prior art arrangements and to provide means for preventing air from blowing-off through each clearance present between adjacent flat bars composing a rotary flat section, which means employs closing plates of a minimum width to cover the associated clearances to provide a complete prevention of the air blowing-off.

It is another object of this invention to provide a rotary flat, which is simple in construction and easy in manufacture and assembly.

SUMMARY OF THE INVENTION

With the above objects in view, the invention resides in a rotary flat section in a carding machine, comprising a pair of endless conveying members supported for rotation in spaced relationship with each other above a cylinder of the carding machine, a plurality of flat bars bridged between and connected to the conveying members with clearances between adjacent pains of the flat bars, and a plurality of means disposed between the adjacent pairs of the flat bars for closing the corresponding clearances, each of the closing means being so connected that its longitudinal center axis always coincides with that of the associated clearance in all positions with respect to a direction of rotation of the rotary flat section. The conveying member consists of an endless chain comprising a plurality of continuous chain links. The fitting of the closing means can be achieved merely by providing the chain links with openings for insertion of connecting means for the closing means. Therefore, the manufacturing and assembling of the flat section can be made easily and economic. Since the closing means is preferably connected to the spaced chains but not to the flat bar, the operations of grinding the flat needles and changing the flat bar or the flat clothing can be carried out without removing the closing means.

Preferably, each flat bar is secured to a connected portion of adjacent chain links, and the closing means in the form of a plate is fixed to the chain link at a substantially mid portion between the adjacent connected portions. This allows the clearance to be closed with a decreased width of the closing plate.

Preferably, the closing plate is provided on its side facing the card cylinder with a relatively soft, elastic member to promote the prevention of the air blowing-off.

BRIEF DESCRIPTION OF THE DRAWINGS

The invention will become more readily apparent from the following detailed description taken in conjunction with the accompanying drawings in which.

DESCRIPTION OF THE PREFERRED EMBODIMENT

Figure 1:
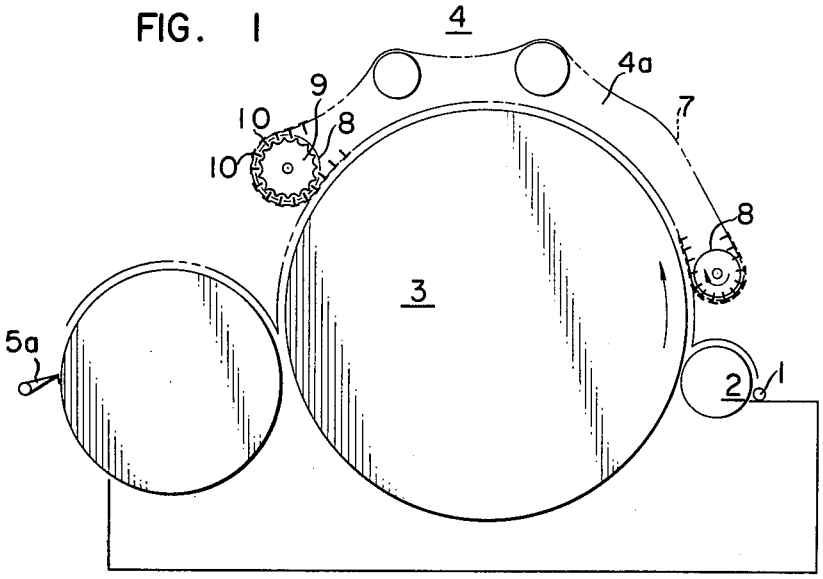
FIG. 1 is a view diagrammatically illustrating an entire construction of a carding machine.

Referring now to the drawings and in particular to FIG. 1, there is generally shown a carding machine for carding laps (not shown) consisting of fibrous material. The laps are fed by a feed roller 1 to a taker-in roller 2, thereby stripping the laps to remove impurities, such as dirt, and hence to a cylinder 3. The laps are moved along an arcuate path formed between the upper surface of the cylinder 3 and a lower run of a rotary flat section 4 and received by a doffer 5. Then, the laps on the doffer 5 are removed by a doffing comb 5*a* and further fed to be subjected to a succeeding processing operation.

Figure 2:
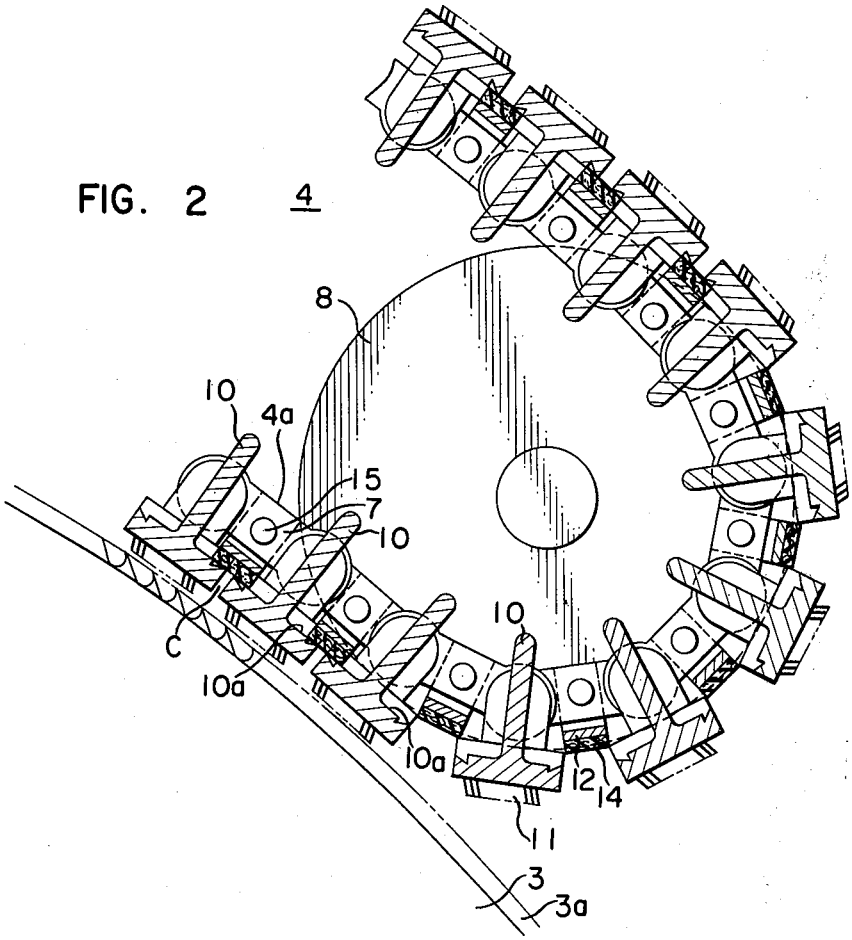
FIG. 2 is a fragmentary elevation section of a flat constructed according to the teachings of the present invention.

In FIGS. 1 and 2, the rotary flat section 4 comprises a plurality of flat bars 10 bridged between a pair of conveyor chains 7 supported for rotation in spaced parallel relation with each other. Section 4 serves to comb the fiber material at positions between a conventional metallic wire 3*a* provided around the cylinder 3 and a flat clothing 11 attached to each flat bar 10. At positions corresponding to the left and right hand runs of the flat section 4, are disposed plain blocks 8 by which the opposed ends of each flat bar 10 are supported when the flat bar 10 reaches the above positions. The driving of the chains 7 and the flat bars 10 is effected through a sprocket wheel 9 connected to a not shown driving means. Flexible bends 6 (see FIG. 3) are arranged to support the lower run of the flat section 4.

With such a flat section 4, since the flat bars 10 are connected to the chains 7, clearances *c* are necessarily present between the adjacent side walls of the flat bars 10. When the flat section 4 is rotated, a relatively high pressure air stream is produced between the cylinder 3 and the flat bars 10 and this air stream tends to enter through the clearances *c* between the adjacent flat bars 10 and accumulate fly in an interior 4*a* of the flat section 4. Therefore, the accumulated fly must be removed from the flat section 4 during the operation of the carding machine or when reinitiating the carding operation.

Figure 3:
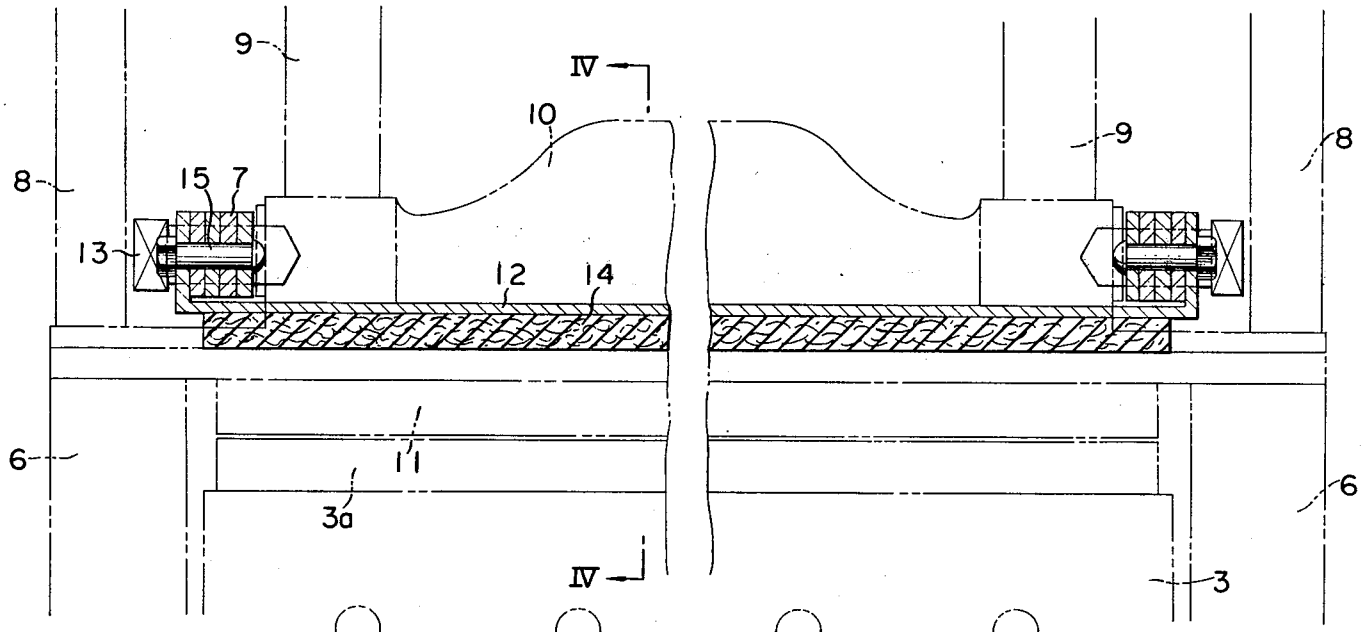
FIG. 3 is a fragmental sectional view of the flat as viewed from the machine direction.
Figure 4:
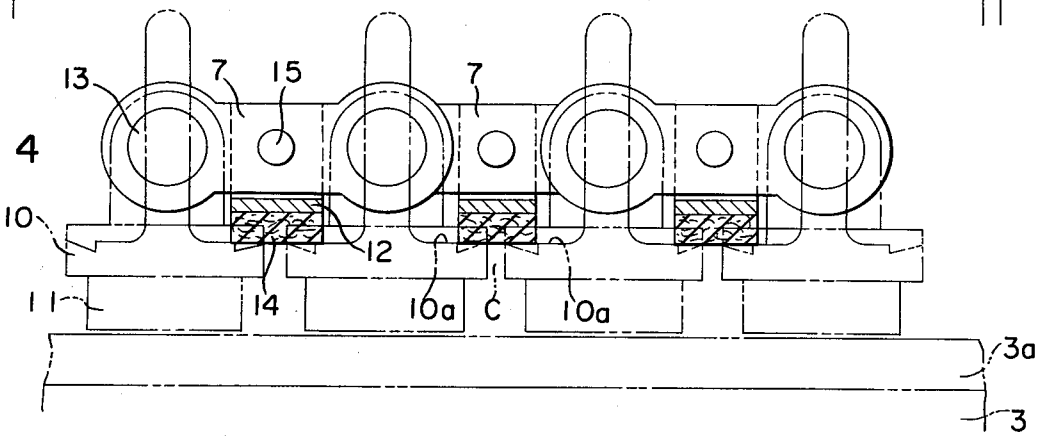
FIG. 4 is a view of the flat taken on the line IV—IV of FIG. 3.
Figure 5:
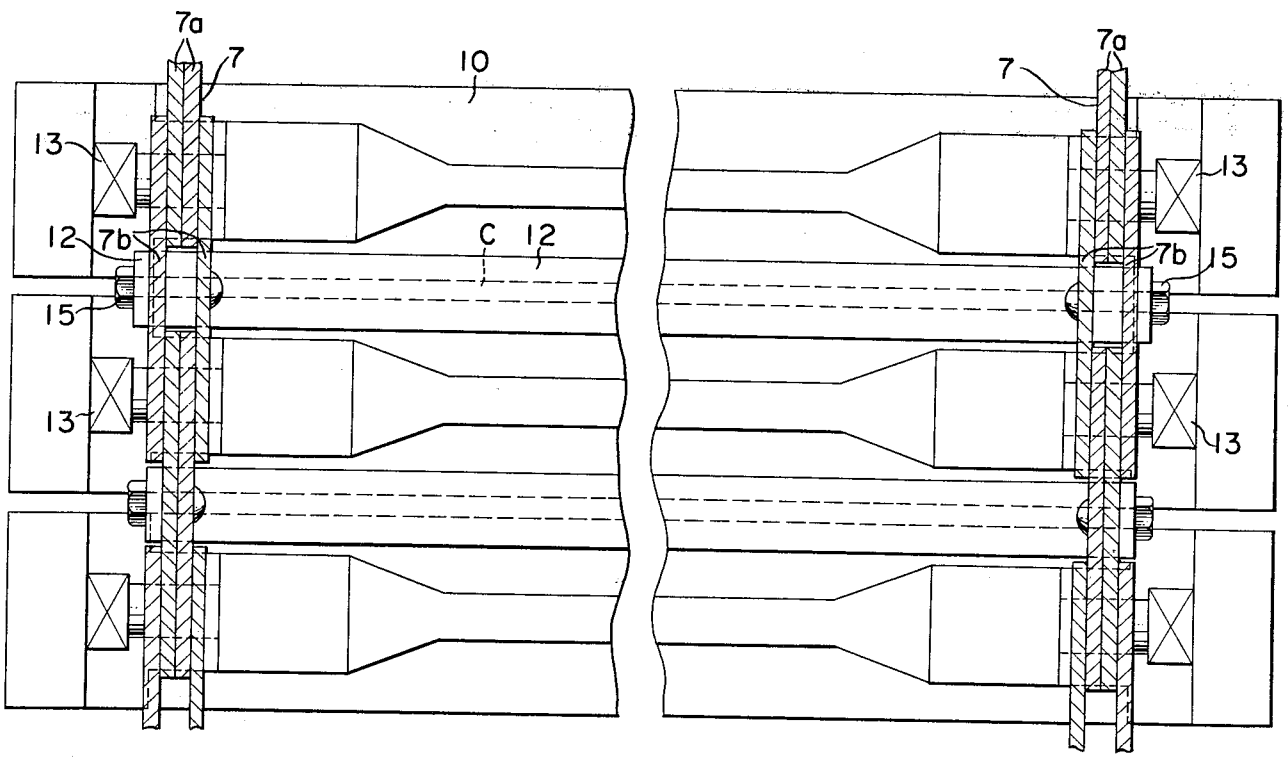
FIG. 5 is a fragmental plan view of the flat with chains shown in section.

According to the present invention, closing members 12 are connected to the chains 7, in a manner that a longitudinal center axis of each closing member 12 coincides with that of the associated clearance *c* in all positions thereof with respect to a direction of rotation of the rotary flat section, to close the associated clearances *c* present between the adjacent flat bars 10 to thereby prevent the air stream from entering the flat section interior 4*a*. In FIGS. 3 and 4 and as best shown in FIG. 5, the chain 7 comprises a plurality of chain links, adjacent two 7*a* and 7*b* thereof being connected together by a suitable connecting means, such as a bolt 13. Each flat bar 10 is connected to a connection of the adjacent links 7*a* and 7*b* by the common bolt 13. At the substantially mid portion of each link, the closing plate member 12 with an elastic plate member 14 attached thereto such as by adhesives is secured by a suitable connecting means, such as a bolt 15, so that the elastic plate member 14 contacts the shoulders 10*a* of the adjacent flat bars 10 which are on the upper or lower run. The size of the closing plate 12 and the elastic plate member 14 is greater than the minimum size of the clearance *c* and therefore it is satisfactory for closing the clearance. The elastic plate 14 may be made of rubber, felt, cloth, plastics foam, or the like.

It is apparent that the closing members 12 can be mounted in the abovementioned manner on portions capable of rotating in unison with the chains 7.

In operation, when the flat section 4 and the cylinder 3 are rotated in the direction shown by the arrows in FIG. 1, the air stream is produced between the lower run of the flat section 4 and the cylinder 3. However, the clearances *c* between the adjacent flat bars 10 on the lower run are satisfactorily covered by the respective closing plate 12 and elastic plate 14, so that the produced air stream as well as the fly is prevented from entering the interior 4*a* of the flat section 4 through the clearances *c*. Since the closing plate member 12 is fixed to the chains at the mid portions of the associated links, it is centrally positioned over the clearance, even when the adjacent flat bars defining the associated clearance are not flush with each other, that is, even when the flat bar is in transition from the lower run to the left hand run or from the right hand run to the lower run. When the flat bar is on the left or right hand run at which its direction is reversed, it is away from the cylinder 3 at some distance so that there is no entrance of the air stream through the clearance *c* into the flat interior 4*a*, even if the width of the clearance on the right or left hand run becomes greater than the width of the elastic plate 14 as can be seen from FIG. 2.

While the invention has been illustrated and described with reference to a single preferred embodiment thereof, it is to be understood that various changes in the details of constructions and the arrangement and combination of parts may be made without departing from the spirit and scope of the invention.

What I claim is:

1. A rotary flat in a carding machine, comprising:

a pair of endless conveying members supported for rotation in spaced relationship to each other above a cylinder of the carding machine;

a plurality of flat bars extending between and connected to said conveying members with clearances between each adjacent pair of said flat bars;

a plurality of closing means, one each positioned between adjacent pairs of said flat bars, for closing the corresponding said clearances; and each said closing means being connected adjacent opposite ends thereof to said conveying members, independently of said flat bars, at positions such that a longitudinal center axis of each said closing means substantially coincides with a longitudinal center axis of the corresponding clearance in all positions of each said closing means during rotation of said conveying members.

2. A rotary flat as claimed in claim 1, wherein each said conveying member comprises an endless chain formed by a plurality of chain links connected in end-to-end relationship with each other; each of said flat bars is connected to said endless chains at positions of connection between adjacent of said chain links; and each of said closing means is connected to said endless chains at positions substantially mid length between adjacent said positions of connection between adjacent of said chain links.

3. A rotary flat as claimed in claim 2, wherein each of said closing means comprises an elongate closing plate member having at opposite ends thereof upwardly extending opposed portions, each said closing plate member being connected to said endless chains with said endless chains positioned between said opposed portions, and an elastic plate member attached to an outer bottom surface of said closing plate member, said elastic plate member being in contact with the adjacent said flat bars.

4. Means for preventing air from blowing-off out of a rotary flat section in a carding machine of the type including a pair of endless conveying members supported for rotation in spaced relationship to each other above a cylinder of the carding machine; a plurality of flat bars extending between and connected to said conveying members with clearances between each adjacent pair of said flat bars; said air blowing-off preventing means comprising:

a plurality of closing plate members, one each positioned between adjacent pairs of said flat bars;

a plurality of elastic plate members, one each attached to one of said closing plate members and in contact with the adjacent said flat bars to close the respective clearance therebetween; and each said closing plate member being connected adjacent opposite ends thereof to said conveying members independently of said flat bars, at positions such that a longitudinal center axis of each said closing plate member substantially coincides with a longitudinal center axis of the corresponding clearance in all positions of each said closing plate member during rotation of said conveying members.

* * * * *